US007731068B2

(12) United States Patent
Scicluna

(10) Patent No.: US 7,731,068 B2
(45) Date of Patent: Jun. 8, 2010

(54) HANGER

(75) Inventor: Paul Victor Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 12/031,928

(22) Filed: Feb. 15, 2008

(65) Prior Publication Data

US 2009/0206114 A1 Aug. 20, 2009

(51) Int. Cl.
*A41D 27/22* (2006.01)

(52) U.S. Cl. ..... 223/91; 223/88; 223/96; 223/DIG. 4

(58) Field of Classification Search ..... 223/85, 223/88–92, 94–96
See application file for complete search history.

(56) References Cited

U.S. PATENT DOCUMENTS

| | | | | | |
|---|---|---|---|---|---|
| 2,214,118 | A | * | 9/1940 | Bracken | 223/85 |
| 2,428,240 | A | * | 9/1947 | Pierce | 223/91 |
| 2,489,492 | A | * | 11/1949 | Kleber | 223/88 |
| 2,701,082 | A | * | 2/1955 | Cohen | 223/85 |
| 2,869,767 | A | | 1/1959 | Citron | |
| 3,001,676 | A | * | 9/1961 | Glotzer | 223/90 |
| 3,131,817 | A | * | 5/1964 | Schenkler | 223/85 |
| 3,409,191 | A | * | 11/1968 | Fuss | 223/91 |
| 3,451,601 | A | * | 6/1969 | Ioviero et al. | 223/85 |
| 3,702,166 | A | * | 11/1972 | Jaffe | 223/85 |
| 3,726,452 | A | * | 4/1973 | Jaffe | 223/91 |
| 4,126,253 | A | | 11/1978 | Voight | |
| 4,168,791 | A | * | 9/1979 | Clark, Jr. | 223/94 |
| 4,261,490 | A | * | 4/1981 | Schwartzstein | 223/88 |
| 5,085,357 | A | * | 2/1992 | Chen | 223/89 |
| 5,113,554 | A | * | 5/1992 | Gallo et al. | 223/88 |
| 5,613,628 | A | * | 3/1997 | Burkhalter | 223/85 |
| 6,000,587 | A | * | 12/1999 | Sackett et al. | 223/85 |
| 6,457,615 | B1 | | 10/2002 | Lam | |

FOREIGN PATENT DOCUMENTS

| | | |
|---|---|---|
| DE | 93 19 456 | 2/1994 |
| DE | 295 14 501 | 11/1995 |
| GB | 677 987 | 8/1952 |
| JP | 10 216000 A | 8/1998 |
| JP | 2005 143936 | 6/2005 |
| WO | WO 99/18832 | 4/1999 |

* cited by examiner

*Primary Examiner*—Gary L Welch
*Assistant Examiner*—Nathan E Durham
(74) *Attorney, Agent, or Firm*—Baker Botts L.L.P.

(57) ABSTRACT

A garment hanger having a first hook, a second hook positioned below the first hook, a pair of arms extending downwardly from the hook members, and a base member arranged in a horizontal position connecting the end portion of the arms. The hook members are attached to the arms by a housing and can pivot to an angular position with respect to the housing. The top portions of the arms are integrally connected and the hook members can rotate around and translate along the top portion. Further, each hook member can spin within the housing independently of the other hook member. Additionally, the base member includes a clamp which can be rotated around the base member and translated along the base member.

12 Claims, 5 Drawing Sheets

HANGER

BACKGROUND OF THE INVENTION

1. Field of the Invention

The present invention relates generally to a garment hanger and more particularly to a garment hanger device which will adequately maintain a garment designed for the upper body such as shirts, blouses, sweaters, jackets, etc. as well as garments designed for the lower body such as pants, skirts, etc., in a secure position on the hanger and in a wrinkle free environment.

2. Description of Related Art

A variety of garment hanger designs are known for hanging garments where the conventional practice is to place a single garment on a hanger. However, many garments are designed to be worn, stored and sold as coordinated outfits or sets. For example, a coordinate jacket and pant set, a coordinate skirt and blouse set, and other such coordinate combinations may be specifically manufactured to be worn, stored and sold as sets. Accordingly, it is desirable to arrange these garments together to convey that the garments are indeed a set to be worn together. Additionally, there are numerous drawbacks to placing a single garment on a hanger such as the number of hangers required for a wardrobe can become excessive, yet the space available in a closet may be scarce thereby prohibiting a large number of hangers.

Further, when the garments on separate hangers are handled together, it is often difficult to place the hanger hooks over a closet rail, which frequently results in dropping and or damage to the garments.

Hangers which are capable of supporting two or more garments, such as a top and pants combination, on a single hanger have a fixed hook portion which restricts the freedom of movement of the garments with respect to the hook, resulting in an increased likelihood of wrinkles being imparted into the garments. This occurrence is exacerbated when a plurality garments are placed on standard hanger designs and stacked or layered, for example in a travel garment bag. In such applications, the rigid hook design forces the portion of the hanger which supports the garments to be displaced, such that each successive hanger is displaced or deflected a greater distance than the preceding hanger. Consequently, the garments are often displaced in response the deflection of the hanger, resulting in wrinkles being formed or the garment being forced off of the hanger entirely.

There thus remains a need for an efficient and economic hanger device which provides an articulated or pivotable hook design in order to overcome the disadvantages of conventional hanger designs.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with the purpose of the invention, as embodied and broadly described, the invention includes a garment hanger comprising a first hook member and a second hook member disposed below the first hook member with a pair of arms extending generally downwardly from the first hook member. A base member connects end portions of the arms such that the first hook member and the second hook member can rotate about an axis which is parallel to the base member.

In an exemplary embodiment, the first hook member has a generally arcuate shape and the second hook member has a generally straight-edge shape. The first hook member and the second hook member are received within a housing and are independently pivotable to an angular position with respect to the housing. Additionally, the first hook member has a first longitudinal axis and the second hook member has a second longitudinal axis, the first and second hook members can rotate independently about the respective longitudinal axis.

The arms of the garment hanger are integrally connected to each other about a top portion and the housing and hook members can move along a length of the top portion. Additionally, the base member includes at least one clamp, wherein the at least one clamp can rotate around the base member axis and move along a length of the base member. Further, the first hook member extends a first distance from the housing member and the second hook member extends a second distance from the housing member, the first distance being greater than the second distance. In some embodiments, the base member has a diameter greater than a diameter of the arms, and at least one of the arms includes an indentation disposed in the middle portion.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method and system of the invention. Together with the description, the drawings serve to explain the principles of the invention.

DETAILED DESCRIPTION OF AN EXEMPLARY EMBODIMENT

Figure 1:
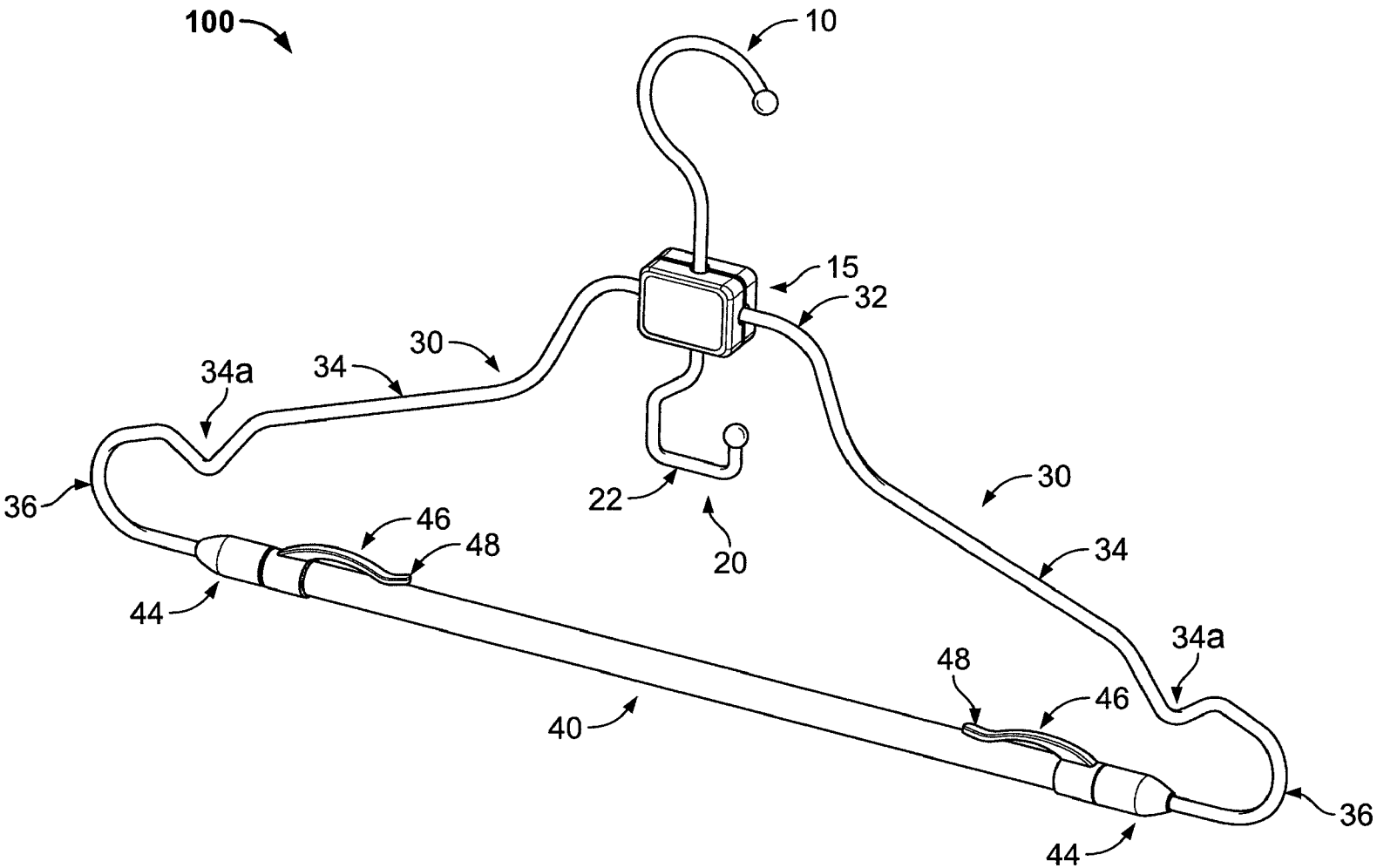
FIG. 1 is a schematic representation of the garment hanger device in accordance with the invention.

Reference will now be made in detail to the present exemplary embodiments of the invention, a depiction of which is illustrated in the accompanying drawings. The method and corresponding steps of the invention will be described in conjunction with the detailed description of the system.

The garment hanger device presented herein may be used for securely supporting a plurality of garments and/or accessories on a single hanger structure. The present invention is particularly suited for use in a garment bag style piece of luggage wherein an articulated hook member can remain engaged with a support rod of the garment bag while being rotated, translated, and/or pivoted such that a plurality of garments remain flat or in plane with the body of the hanger. For purpose of explanation and illustration, and not limitation, an exemplary embodiment of the system in accordance with the invention is shown in FIG. 1 and is designated generally by reference character 100.

As shown in FIG. 1, the system 100 generally includes a first hook member 10 depicted in the illustrated embodiment as a generally arcuate hook. Such an arcuate shape is preferred since the majority of support rods in storage closets are cylindrical in shape. Thus, an arcuate first hook member 10 will allow the garment hanger of the present invention to be employed in a wide variety of applications. Coupled to the first hook member 10 and extending downward is a second hook member 20, depicted herein as a straight-edge hook. The straight-edge hook configuration is particularly suited for supporting a wide array of accessories such as belts, ties, etc., additional garment hangers.

Additionally, and in accordance with an aspect of the invention, the straight-edge portion 22 of the second hook 20 can be configured to facilitate attachment to a garment bag. In other words, the straight-edge portion 22 is adapted to cooperate with the attachment clip or rod, which is typically rectangular, to securely position the hanger within a garment bag. Further, the length of the second hook 20 can be shorter than the length of a typical hanger hook, e.g. hook 10, in order to allow garments to fit completely within the garment bag by reducing the distance from the top of the hook to the bottom of the garment. First hook 10, on the other hand can be of conventional size and shape allowing for convenient use in a closet. Therefore, the hanger of the present invention allows for a single hanger to be adapted for engagement with either a conventional closet support rod or a garment bag, as desired. Extending generally downward from the hook members 10, 20 is a pair of arms 30 having end portions which are joined by a generally horizontal base member 40.

Figure 2:
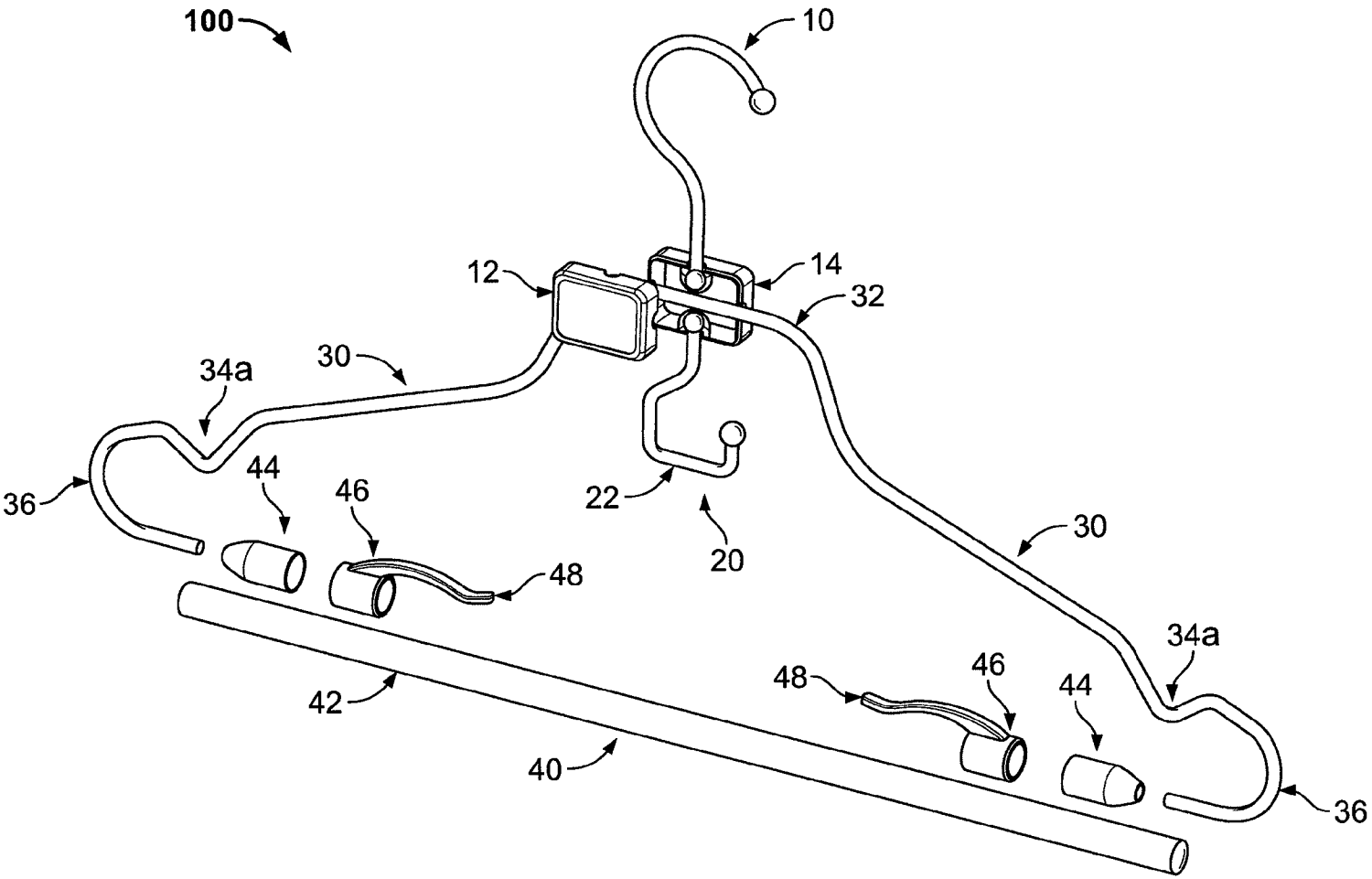
FIG. 2 is an exploded view of the garment hanger device shown in FIG. 1.

In accordance with another aspect of the invention, and as illustrated in FIG. 2, the first hook member 10 and second hook member 20 are coupled within housing 15 which includes a first panel 12 and a second panel 14. Similarly, the arms 30 are configured to be received within the housing 15. Panels 12, 14 are in one embodiment attached with removable fasteners, e.g. screws, however alternative fastening means can be utilized if so desired. In an exemplary embodiment, both panels 12, 14 have U-shaped channels formed in each side thereof such that upon union of the panels, the U-shaped channels of each panel 12, 14 correspond in position to form a plurality of slots in the housing 15 to receive the hook members 10, 20 and the arms 30.

Figure 4A:
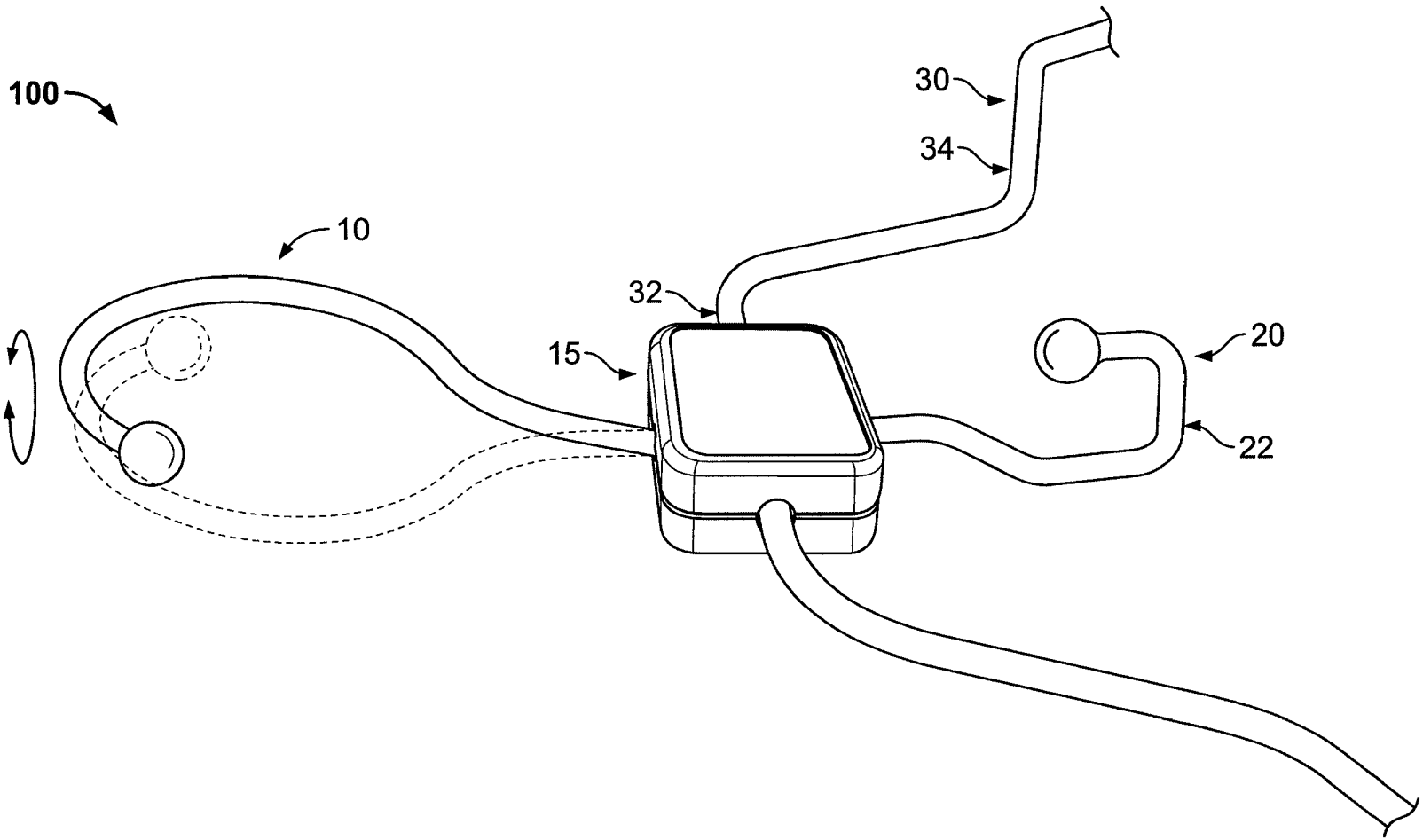
FIGS. 4A-B are a schematic representations of the garment hanger device shown in FIG. 1 illustrating a second and third range of motion of the hook portions.
Figure 4B:
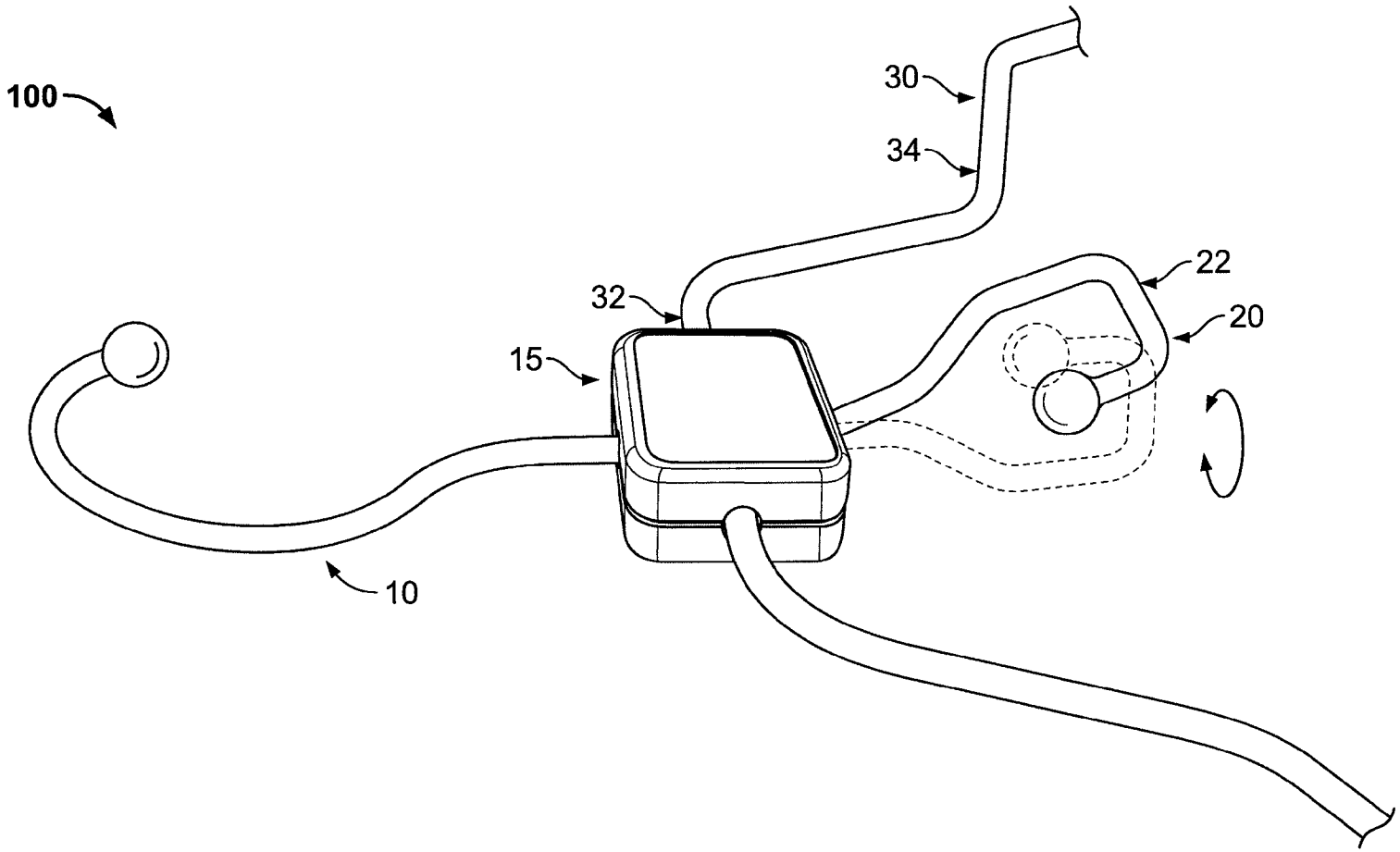

In an exemplary embodiment, the slots which correspond to the hook members 10, 20 are sized such that a gap exists between each hook member and the boundary of the slot when the hook members are received in the housing 15. This gap provides a range of movement for the hook, e.g., forward or backward, with respect to the housing 15. Accordingly, the hook members 10, 20 are articulated in that each hook member can be pivoted to maintain engagement with the support rod (not shown) of the luggage without deflecting the remainder of the garment hanger structure. FIGS. 4A-4B illustrate the hook members 10, 20 in an initial position (shown in phantom) and a second position (shown in solid lines) in which the hook members are pivoted to be positioned at an angle with respect to the housing 15. Therefore, due to this pivot feature of the hook members, the garments remain flat and are not prone to wrinkles when a plurality of garment hangers are stacked or layered in a garment bag, as discussed above. Furthermore, each hook member can be pivoted or displaced independent of the other hook. For example, arcuate hook member 10 can be pivoted forward, while straight-edge hook 20 can simultaneously be pivoted backward.

Additionally, the housing 15 securely couples the hook members 10, 20 to the garment hanger device while allowing each hook member 10, 20 to spin 360° within the housing 15. In other words, each hook member 10, 20 has a longitudinal axis about which the hook member can freely spin or rotate, as illustrated by the arrow depicted in FIGS. 4A-4B. Thus the garment hanger device can be positioned on a support rod from either direction since the hook members can be turned from a left facing to right facing (which is illustrated in FIGS. 1-2). Furthermore, each hook member 10, 20 can spin independently of the other. This freedom of rotation is provided by the construction of the housing 15 and engagement of the panels 12, 14 with the hooks 10, 20.

As shown in FIG. 2, each panel 12, 14 includes a hemispherical-shaped socket for receiving a protuberance, e.g., a ball located at the end of each hook 10, 20 wherein the sockets are aligned with the U-shaped channels discussed above. The ball at the end of each hook is larger than the size of the U-shaped channels. Therefore, upon union of the two panels 12, 14, the two hemispherical-shaped sockets engage the ball at the end of each hook to prevent the hooks from being removed from the housing 15, yet allowing for independent rotation and pivoting, as discussed above.

In accordance with another aspect of the invention, the housing 15 is configured to be securely coupled to the arms 30 of the hanger device while providing for rotational movement of the housing 15 with respect to the arms 30. Accordingly, the hook members can be arranged, as illustrated in FIGS. 1-2, wherein the arcuate hook member 10 is disposed above the straight-edge hook member 20. However, the housing 15 can rotate 360° such that if rotated 180°, the straight-edge hook member 20 is disposed above the arcuate hook member 10.

Therefore, the hook members 10, 20 of the present invention are provided with numerous degrees of freedom. For example, each hook can independently pivot into or out of the plane of the housing 15, independently spin within housing 15, and both hook members can simultaneously rotate around the arms 30. Additionally, the slots of the housing 15 which receive arms 30 are configured to allow the housing 15 to move along a length of the top portion 32 of the arms. This freedom of movement is advantageous since it allows for the re-orientation of the hanger device to prevent deflection of the garment hanger structure and maintaining the garments in a straight or flat position to avoid formation of wrinkles.

This is particularly beneficial in embodiments where one garment hanger is attached to another garment hanger to form a "tree" or tiered hanger assembly. In such embodiments, the first hook 10 of a hanger is engaged with a second hook 20 of another hanger to increase the number of garments which may be supported by the hanger system. The freedom of movement of the hook members 10, 20 allows a plurality of hangers to be attached to one another without creating undesirable bulk or interference with the garments.

As illustrated in FIGS. 1-2, the arms 30 have a first portion 32 disposed at the top of the hanger device. In an exemplary embodiment, the arms are integrally joined along top portion 32, such that the two downwardly extending arms are formed as a single continuous structure, as shown in FIG. 2. A second portion of the arms 34 can include an indentation 34*a* formed therein which enhances the structural integrity of the hanger device. When a heavy garment such as a jacket or coat is placed on the garment hanger, the indentation allows the load to be distributed through the arms 30 such that any buckling that may occur is limited to the arms 30 and does not alter the shape of the horizontal base member 40. This is advantageous in applications in which a pair of trousers or a skirt is supported by the base member 40 since the prevention of distortion of the base member 40 avoids the formation of wrinkles in the garments. Additionally, the indentation 34*a* can further serve as a retention feature for garments that have support loops such as skirts or blouses which may be positioned within the indentation.

In an exemplary embodiment, base portion 40 extends horizontally between the arm ends 36 with generally a cylindrical shape and has a diameter which is greater than the diameter of the arms 30. The larger diameter of the base member 40 serves to reinforce the hanger device structure and provide stability for supporting garments disposed thereon. As shown in FIG. 2, the base member 40 includes beam 42 which is received in cone-shaped tips 44. The cone-shaped tips have an aperture for receiving the beam on a first side, and the arm ends 36 of the arm members on a second side.

Figure 3:
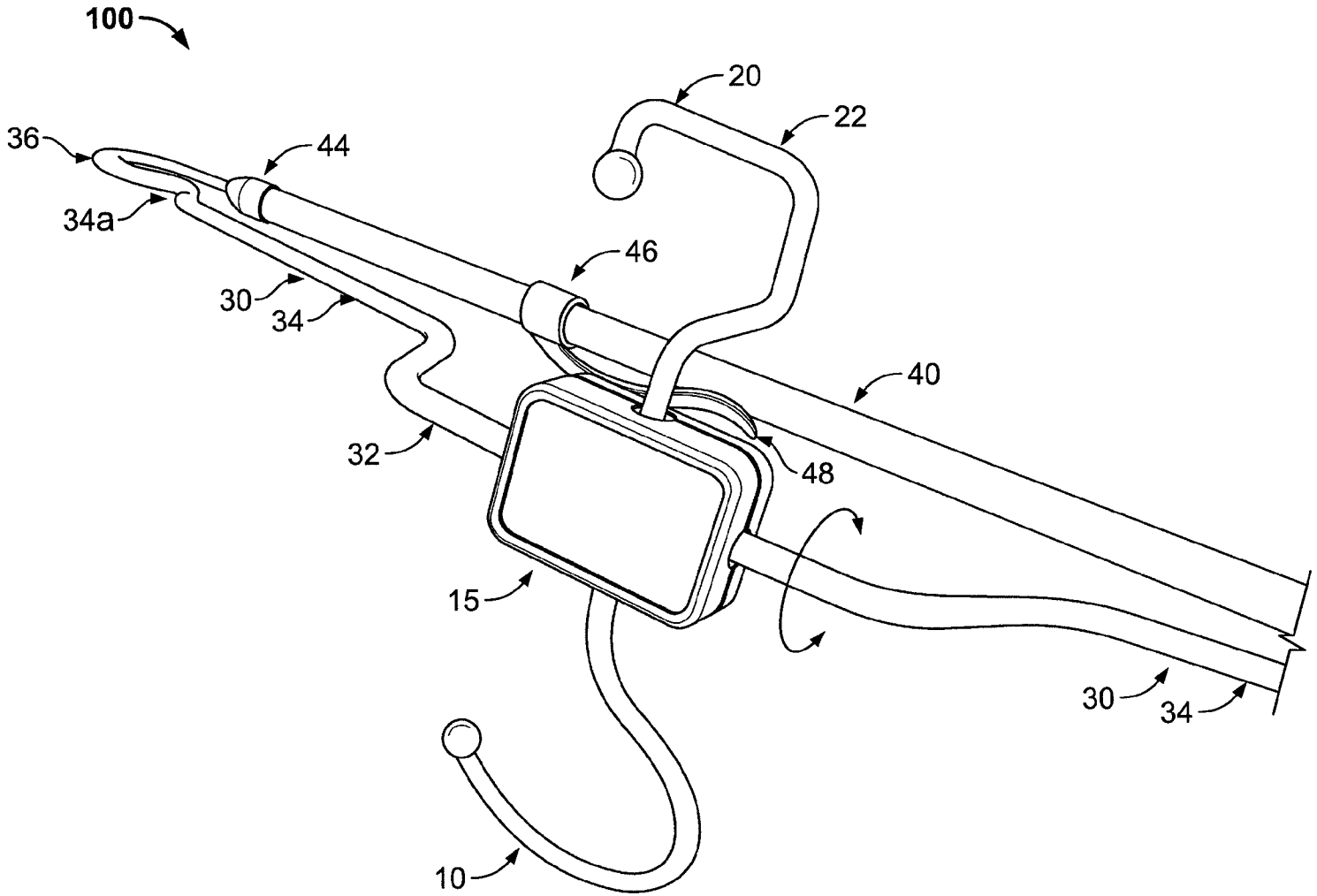
FIG. 3 is a schematic representation of the garment hanger device shown in FIG. 1 illustrating a first range of motion of the hook portions.

Additionally, retention features 46, embodied in FIGS. 1-2 as clamp members, can be provided on the base member 40 for securing a garment to the base member. Further, as shown in FIG. 3, the clamps 46 are configured to slide along the base member 40 in a translating fashion, as well as rotate around the base member 40, when the clamps are in a first position in which no garments are attached to the clamp members, as described in further detail below. In some embodiments, the cone-shaped tips 44 are sized to serve as a barrier to limit the range of translational movement of the clamps 46 between the two tips 44.

Clamps 46 are particularly suited for use with garments which have support loops such as skirts wherein the clamps 46 are rotated into position with the clamp tongs 48 on the bottom surface of the base member. With the clamp 46 in this position, the hanging loop of the garment can be secured between the base member 40 and the clamp 46 to allow the garment to hang straight downward, thereby minimizing the formation of wrinkles. The weight of the garment is supported by clamp tongs 48 such that the tong is displaced which in turn generates a frictional force between clamp member 46 and base member 40 to inhibit relative motion, i.e., either rotation or translation, between the clamp member 46 and the base member 40.

Additionally, with the clamp tongs 48 positioned on the top surface of the base member 40, the hanger is well suited to hold pants in place. For example, the clamp tongs 48 are lifted and the pants are inserted between the base member 40 and clamp tongs 48. The clamp tongs 48 provide a downward force in this configuration which secures the pants to the hanger and prevents formation of wrinkles. Again, with the clamp tongs 48 in this second, or raised position as described herein, the tong 48 is biased to exert a frictional force between the clamp 46 and base member 40 to inhibit relative movement between the clamp 46 and base 40. However, this frictional force can be overcome by the user and the clamps 46 can be moved even when in a second position in which the tong member 48 is displaced by a garment, if so desired.

While the present invention is described herein in terms of certain exemplary embodiments, those skilled in the art will recognize that various modifications and improvements may be made to the invention without departing from the scope thereof. For example, while the invention is illustrated primarily in terms of a garment hanger of a particular geometry, the invention may be applied to various hanger geometries and dimensions. Moreover, although individual features of one embodiment of the invention may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the invention is also directed to other embodiments having any other possible combination of the dependent features claimed below and those disclosed above. As such, the particular features presented in the dependent claims and disclosed above can be combined with each other in other manners within the scope of the invention such that the invention should be recognized as also specifically directed to other embodiments having any other possible combinations. Thus, the foregoing description of specific embodiments of the invention has been presented for purposes of illustration and description. It is not intended to be exhaustive or to limit the invention to those embodiments disclosed.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

The invention claimed is:

1. A garment hanger comprising:

a first hook member extending in a first direction from a rotation point;

a second hook member extending in a second substantially opposite direction from the rotation point;

a pair of arms extending generally away from the rotation point;

a base member connecting end portions of the arms;

wherein the first hook member and the second hook member are rotatable about the rotation point; and wherein the first hook member and the second hook member are received within a housing and are pivotable to an angular position with respect to the housing; and wherein the first hook member has a first longitudinal axis and the second hook member has a second longitudinal axis, the first hook member is rotatable about the first longitudinal axis and the second hook member is rotatable about the second longitudinal axis.

2. The garment hanger of claim 1, wherein the first hook member has a generally arcuate shape.

3. The garment hanger of claim 1, wherein the second hook member has a generally straight-edge shape.

4. The garment hanger of claim 1, wherein the arms are integrally connected to each other about a top portion and the housing is moveable along a length of the top portion.

5. The garment hanger of claim 1, further comprising at least one clamp member disposed on the base member, wherein the at least one clamp member is rotatable around the base member axis and moves along a length of the base member when the at least one clamp member is in a first position.

6. The garment hanger of claim 5, wherein the at least one clamp member is biased to provide a force that inhibits rotation about the base member and movement along the length of the base member when the at least one clamp member is in a second position.

7. The garment hanger of claim 1, wherein the first hook member and the second hook member can pivot independent of each other.

8. The garment hanger of claim 1, wherein the first hook member and the second hook member can rotate about an axis which is parallel to the base member.

9. The garment hanger of claim 1, wherein the first hook member and the second hook member can rotate independent of each other.

10. The garment hanger of claim 1, wherein the first hook member extends a first distance from the housing member and the second hook member extends a second distance from the housing member, the first distance being greater than the second distance.

11. The garment hanger of claim 1, wherein the base member has a diameter greater than a diameter of the arms.

12. The garment hanger of claim 1, wherein at least one of the arms includes an indentation disposed in a middle portion of the arms.

* * * * *